United States Patent [19]

Sofia et al.

[11] Patent Number: 4,795,531

[45] Date of Patent: Jan. 3, 1989

[54] METHOD FOR DEWATERING PAPER

[75] Inventors: Samuel C. Sofia, Saint Charles; Kerrie A. Johnson, Aurora; Marla S. Crill, Oak Park; Martin J. Roop, Saint Charles, all of Ill.; Steven R. Gotberg, Mobile, Ala.; Anthony S. Nigrelli, Portage, Mich.; Laurence S. Hutchinson, Waterville, Me.

[73] Assignee: Nalco Chemical Company, Naperville, Ill.

[21] Appl. No.: 99,585

[22] Filed: Sep. 22, 1987

[51] Int. Cl.[4] ..... D21H 3/36

[52] U.S. Cl. ..... 162/164.6; 162/168.2; 162/168.3; 162/181.6; 162/183

[58] Field of Search ..... 162/168.2, 168.3, , 162/181.6, 183, 164.6

[56] References Cited

U.S. PATENT DOCUMENTS

| | | | |
|---|---|---|---|
| 4,385,961 | 5/1983 | Svending et al. | 162/175 |
| 4,388,150 | 6/1983 | Sunden et al. | 162/175 |
| 4,445,970 | 5/1984 | Post et al. | 162/181.6 |
| 4,643,801 | 2/1987 | Johnson | 162/164.1 |
| 4,710,270 | 12/1987 | Sunden et al. | 162/181.6 |

FOREIGN PATENT DOCUMENTS

| | | | |
|---|---|---|---|
| 1110019 | 10/1981 | Canada | 162/168.3 |

OTHER PUBLICATIONS

Falcone, *Silicates in Paper Products Improve Strength and Functional Performance,* Pulp & Paper, Jan. 1976, pp. 93–96.

Merrill, *Sorption of Sodium Silicates and Silica Sols by Cellulose Fibers,* Industrial Engineering Chem., (1950), pp. 744–747.

*Primary Examiner*—Peter Chin

*Attorney, Agent, or Firm*—John G. Premo; Anthony L. Cupoli; Donald G. Epple

[57] ABSTRACT

A method of enhancing the dewatering of paper during the papermaking process which includes adding a low molecular weight cationic coagulant and then colloidal silica and a high molecular weight flocculant.

5 Claims, No Drawings

METHOD FOR DEWATERING PAPER

FIELD OF THE INVENTION

The field of the invention is papermaking. More particularly, the invention relates to a process for improving the dewatering of paper as it is being made.

BACKGROUND OF THE INVENTION

Paper is made by applying processed paper pulp to a fourdrenier machine. In order to remove the paper produced, it is necessary to drain the water from the paperstock thereon. The use of colloidal silica together with cationic starch has proved beneficial in providing drainage.

It would be advantageous to provide a drainage method with improved results.

SUMMARY OF THE INVENTION

The invention is a method for dewatering used in a papermaking process. The method includes applying a low molecular weight cationic polymer to pulp (including recycled paperpulp); and then adding a colloidal silica and a high molecular weight charged acrylamide polymer.

The low molecular weight (LMW) cationic polymers will be positively charged polymers having a molecular weight of at least 2000. Although polymers having molecular weights of 200,000 are acceptable. Preferred polymers include epichlorohydrin/dimethylamine (epi/DMA) and ethylene dichloride/ammonia copolymer (EDC/$NH_3$), diallyldimethylammonium chloride (polyDADMAC) copolymers and acrylamido N,N-dimethyl piperazine quaternary/acrylamide copolymer. The broadest range afforded the low molecular weight polymers are 1000 to 500,00 Mw.

The high molecular weight (HMW) charged polymers are preferably acrylamide polymers which can include either cationic monomers or anionic monomers. Generally they will have a Mw of at least 500,000. Higher molecular weight polymers having a molecular weight greater than 1,000,000 are most preferred.

The low molecular weight cationic polymer preferably will be fed on a dry basis at 0.1 to 25 #/ton furnish. More preferably the low molecular weight polymer will be fed at 0.2 to 10 #/ton furnish.

The high molecular weight charged acrylamide copolymer should be fed at 0.1 to 5 #/ton furnish on a dry basis. More preferably at 0.2 to 3 #/ton furnish.

DESCRIPTION OF THE PREFERRED EMBODIMENTS

In a preferred embodiment, a low molecular weight cationic polymer is added to paper feedstock. This low molecular weight cationic polymer tends to neutralize the charge on the paper feedstock to facilitate coagulation thereof. Subsequent to this addition of low molecular weight polymer, a high molecular weight polyacrylamide and colloidal silica should be added to the paper feedstock. The process will work irregardless of the order of addition of the silica and the high molecular weight polymer with respect to each other. However, the order may be important for optimization of performance and that optimal order can vary with the mill system being treated.

ANIONIC HIGH MOLECULAR WEIGHT FLOCCULANTS

The high molecular weight anionic polymers are preferably water-soluble vinylic polymers containing monomers from the group acrylamide, acrylic acid, AMPS and/or admixtures thereof., and may also be either hydrolyzed acrylamide polymers or copolymers of acrylamide or its homologues, such as methacrylamide, with acrylic acid or its homologues, such as methacrylic acid, or perhaps even with monomers, such as maleic acid, itaconic acid or even monomers such as vinyl sulfonic acid, AMPS, and other sulfonate containing monomers. The anionic polymers may be homopolymers, copolymers, or terpolymers. The anionic polymers may also be sulfonate or phosphonate containing polymers which have been synthesized by modifying acrylamide polymers such a way as to obtain sulfonate or phosphonate substitution, or admixtures thereof.

The most preferred high molecular weight copolymer are acrylic acid/acrylamide copolymer; and sulfonate containing polymers, such as 2-acrylamido-2-methylpropane sulfonate/acrylamide; acrylamido methane sulfonate/acrylamide; 2-acrylamido ethane sulfonate/acrylamide; 2-hydroxy-3-acrylamide propane sulfonate/acrylamide. Commonly accepted counter ions may be used for the salts such as sodium ion, potassium ion, etc.

The acid or the salt form may be used. However, it is perferble to use the salt form of the charged polymers disclosed herein.

The anionic polymers may be used in solid, powder form, aqueous, or may be used as water-in-oil emulsions where the polymer is dissolved in the dispersed water phase of these emulsions.

It is preferred that the anionic polymers have a molecular weight of at least 500,000. The most preferred molecular weight is at least 1,000,000 with best results observed when the molecular weight is between 5–30 million. The anionic monomer should represent at least 2 mole percent of the copolymer and more preferably the anionic monomer will represent at least 20 mole percent of the over-all anionic high molecular weight polymers. By degree of substitution, we mean that the polymers contain randomly repeating monomer units containing chemical functionality which when dissolved in water become anionically charged, such as carboxylate groups, sulfonate groups, phosphonate groups, and the like. As an example a copolymer of acrylamide (AcAm) and acrylic Acid (AA) wherein the AcAm:AA monomer mole ratio is 90:10, would have a degree of substitution of 10 mole percent. Similarly copolymers of AcAm:AA with monomer mole ratios of 50:50 would have a degree of anionic substitution of 50 mole percent.

CATIONIC HIGH MOLECULAR WEIGHT POLYMER FLOCCULANTS

The cationic polymers used are preferably high molecular weight water soluble polymers having a weight average molecular weight of at least 500,000, preferably a weight average molecular weight of at least 1,000,000 and most preferably having a weight average molecular ranging from about 5,000,000 to 25,000,000.

Exemplary high molecular weight cationic polymers include diallyldimethylammonium chloride/acrylamide copolymer; 1-acryloyl-4-methyl-piperazine methyl sulfate quat/(AMPIQ) acrylamide copolymer; dimethylaminoethylacrylate quaternary/acrylamide copolymer (DMAEA); dimethyl aminoethyl methacrylate quaternary (DMAEA)/acrylamide copolymer, methacrylamido propyl trimethylammonium chloride homopolymer (MAPTAC) and its acrylamide copolymer.

It is generally preferred that the cationic polymer be an acrylamide polymer with a cationic comonomer. The cationic comonomer should represent at least 2 mole percent of the overall polymer, more preferably, the cationic comonomer will represent at least 20 mole present of the polymer.

THE DISPERSED SILICA

Preferably, the cationic or anionic polymers are used in combination with a dispersed silica having an average particle size ranging between about 1–100 nanometers (nm), preferably having a particle size ranging between 2–25 nm, and most preferably having a particle size ranging between about 2–15 nm. This dispersed silica, may be in the form of colloidal, silicic acid, silica sols, fumed silica, agglomerated silicic acid, silica gels, and precipitated silicas, as long as the particle size or ultimate particle size is within the ranges mentioned above. The dispersed silica is normally present at a weight ratio of cationic coagulant (i.e. LMW cationic polymer) to silica of from about 100:1 to about 1:1, and is preferably present at a ratio of from 10:1 to about 1:1.

This combined admixture is used within a dry weight ratio of from about 20:1 to about 1:10 of high Mw polymer to silica, preferably between about 10:1 to about 1:5, and most preferably between about 8:1 to about 1:1.

The following examples demonstrate the method of this invention.

EXAMPLE 1

500 mls. paper stock mixed with the additives in the following order of addition:

1. low molecular weight cationic polymer;
2. high molecular weight polymer
3. colloidal silica.

These samples were mixed after each addition of chemicals in a 500 ml. graduated cylinder, then the samples received 3 seconds mixing at 1000 rpm. The samples were then drained through a laboratory drainage tester; the first 5 seconds of filtrate being collected for testing. The results are provided in Table I.

TABLE I

| HMW Polymer Product | Dry(lb/ton) | (lb/ton)* Cationic Starch | LMW Polymer Product | Dry(lb/ton) | Colloidal Silica | 270 | Drainage mLs/5 sec |
|---|---|---|---|---|---|---|---|
| 110 | 0.5 | | 200 | 1.3 | | | 175 |
| 110 | 0.75 | | 200 | 1.3 | | | 190 |
| 110 | 0.75 | | 200 | 3.75 | | | 275 |
| 110 | 1.0 | | 200 | 1.3 | | | 180 |
| 110 | 0.75 | | 200 | 1.3. | 0.75 | | 195 |
| 110 | 0.75 | | 200 | 1.3. | 0.75 | | 200 |
| 110 | 0.75 | | 200 | 2.6. | 0.75 | | 205 |
| 110 | 0.75 | | 200 | 3.75. | 0.75 | | 295 |
| 110 | 0.4 | | 200 | 1.3. | 0.75 | 1.3 | 195 |
| 110 | 0.75 | | 260 | 1.3 | 3.75 | 1.3 | 220 |
| 120 | 0.5 | | 200 | 1.3 | | | 205 |
| 120 | 0.75 | | 200 | 1.3 | | | 205 |
| 120 | 1.0 | | 200 | 1.3 | 0.75 | | 240 |
| 120 | 0.75 | | 200 | 1.3 | 0.75 | | 340 |
| 110 | 0 | 20 | | | 3.75 | | 230 |
| 110 | 0.75 | 20 | | | 3.75 | | 280 |

*Pounds per ton
110 - HMW acrylamide, acrylic acid copolymer, anionic, Mw ~10 to 15 million
120 - HMW acrylamide, DMAEA copolymer, cationic Mw ~5 to 10 million
200 - Crosslinked epi/DMA, LMW cationic Mw ~50,000
260 - Linear epi/DMA, LMW cationic polymer Mw ~20,000
Colloidal silica - 4–5 nm
270 - Poly aluminum chloride and 260 (95:5 mole ratio)
Cationic Starch - Cationic potato starch, 0.035 degree of substitution

EXAMPLE 2

500 mls. paper stock mixed with the following additives added while mixing the sample at 1000 rpm. The additives were added at 5 second intervals.

1. Low molecular weight cationic polymer.
2. High molecular weight polymer
3. Colloidal silica.

The samples were then drained through a laboratory drainage tester with the first 5 seconds of filtrate being collected for testing. The results are provided in Table II.

TABLE II

| HMW Polymer Product | Dry(lb/Ton) | LMW Polymer Product | Dry(lb/Ton) | Colloidal Silica(lb/Ton) | Drainage mLs/5 sec |
|---|---|---|---|---|---|
| | 0.5 | | 0 | 0 | 155 |
| 110 | 0.75 | 200 | 1 | 2 | 245 |
| 110 | 0.75 | 200 | 2 | 2 | 325 |
| 110 | 0.75 | 200 | 3 | 2 | 340 |
| 110 | 0.75 | 200 | 1 | 0 | 210 |
| 110 | 0.75 | 200 | 2 | 0 | 265 |
| 110 | 0.75 | 200 | 3 | 0 | 295 |
| 110 | 0.75 | 210 | 1 | | 230 |
| 110 | 0.75 | 210 | 2 | | 310 |
| 110 | 0.75 | 210 | 2 | | 305 |
| 110 | 0.75 | 210 | 3 | | 340 |
| 110 | 0.75 | 210 | 2 | 2 | 365 |

TABLE II-continued

| HMW Polymer Product | Dry(lb/Ton) | LMW Polymer Product | Dry(lb/Ton) | Colloidal Silica(lb/Ton) | Drainage mLs/5 sec |
|---|---|---|---|---|---|
| 110 | 0.75 | 220 | 1 | | 260 |
| 110 | 0.75 | 220 | 2 | | 285 |
| 110 | 0.75 | 220 | 3 | | 305 |
| 110 | 0.75 | 230 | 1 | | 265 |
| 110 | 0.75 | 230 | 2 | | 285 |
| 110 | 0.75 | 230 | 3 | | 315 |
| 110 | 0.75 | 240 | 1 | | 265 |
| 110 | 0.75 | 240 | 2 | 2 | 295 |
| 110 | 0.75 | 240 | 3 | | 295 |
| 110 | 0.75 | 250 | 1 | | 140 |
| 110 | 0.75 | 250 | 2 | | 150 |
| 110 | 0.75 | 250 | 3 | | 180 |
| 110 | 0.75 | 260 | 1 | | 195 |
| 110 | 0.75 | 260 | 2 | | 230 |
| 110 | 0.75 | 260 | 3 | | 235 |
| 110 | 0.75 | 270 | 1 | | 170 |
| 110 | 0.75 | 270 | 2 | | 220 |
| 110 | 0.75 | 270 | 3 | | 250 |

LMW Cationic Polymers:
200 - Crosslinked epi/DMA, LMW cationic Mw ~50,000
260 - Linear epi/DMA, LMW cationic polymer Mw ~20,000
210 - EDC/ammonia copolymer Mw ~30,000
220 - polyDADMAC, ~100,000 MW
230 - PolyDADMAC, ~150,000 MW
240 - PolyDADMAC, ~200,000 MW
250 - Acrylamide, DMAEM MCQ copolymer, HMW (MCQ=methyl chloride quat), Mw ~10 to 15 million
270 - Poly aluminum chloride and 260 (95:5 mole ratio)
Colloidal Silica - 4–5 nm, dosage on dry basis
110 - Acrylic acid, acrylamide copolymer, HWM anionic, Mw ~10 to 15 million

EXAMPLE 3

Plant A has a six vat, cylinder machine currently producing recycled board for various end uses. Weights range from 50 to 150 lb/3000 sq. ft. with calipers in the 20–40 pt. range. The furnish is 100% recycled fiber.

The current program consists of the following:

1. LMW 200 as a coagulant fed to the machine chest at dosages typically between 1 and 6 #/ton as needed to control the charge in the vats between −0.02 and 0.01 MEQ./ML.

2. HMW 110 fed as a flocculant after the screens to each individual vat through a bank of rotometers to control dosage. Dosages are typically in the range of 1 to 4 #/ton as needed for retention and drainage profile modification.

3. Colloidal silica fed directly into the post-dilution water for the HMW 110. After mixing with the dilution water and the HMW 110, passes through a static mixer, a distribution header and then through the rotometers mentioned above and onto the machine. Typical dosages to date have been in the range of 0.5 to 1.0 dry pounds per ton.

4. A cationic pregellatinized potato starch with 0.025 d.s. is added on one very high strength grade at 40 #/ton for added Ply-Bond. Bags of the starch are normally thrown into the beater at 15 minute intervals (depending on production rate) by the beater engineer.

With the addition of the colloidal silica in the 0.5 to 1.0 #/ton (all colloidal silica dosages should be assumed to be in Dry #/ton unless stated otherwise) to dual polymer program we have seen the following results:

1. Within 10 minutes of adding the silica sheet moisture dropped from 7.5% to 1.5% moisture. This in turn resulted in the backtender reducing the stream in the high pressure dryers from 120 to 70 PSI.

2. After moistures were again in line, the machine was sped up to 10 to 15% without putting all the steam back in. On some of the heavier weights we have actually run out of stock before reaching their normal steam limited condition. On the lighter weight grades we normally run out of turbine speed before running out of steam. Steam savings even on the lighter grades are significant, normally 10 to 30%.

3. Vat drainage rates increased 30 to 50%. In general the vat drainages went from an initial 35 to 40 Schoppler-Riegler Freeness to a 15 to 20 level. The same results were seen using a laboratory drainage tester which increased from 150 mL/5 sec. to nearly 300 mL/5 sec. for a 500 ml. sample at 0.5–1.0% consistency. The vat level controls responded by adding more dilution water which lowered the proud consistency and resulted in a much improved sheet formation.

4. Retentions improved from a typical 85 to 92% up as high as 99% on the heavier weights. In general retention was improved significantly, to the point in fact that there were so few solids going to the saveall that we were having a very difficult time forming a mat without sweetener stock. On the lightest weight grades retention improvements of 10 to 25% were achieved over and above a reasonably well optimized dual polymer program.

5. Ply bonding, Mullen, and cockling were also improved as a result of the addition of silica. On their heavily refined grades they generally have to slow way back due to severe cockling and slow drying. The addition of the silica eliminated much of this problem and they have been able to speed up to record production rates on these grades. Ply Bond and Mullen also improved 10 to 30 points primarily due to better formation.

6. It is very important to note that the addition of starch is in no way necessary to the performance of this program. We have run both with and without starch and have never seen the starch have any bearing on program performance.

Having described our invention we claim as follows:

1. A method for dewatering paper comprising steps of adding to paper furnish, from 0.1 to 25 pounds per ton on a dry basis, based on furnish of a low molecular weight cationic organic polymer having Mw within the range of 2000 to 200,000, said low molecular weight cationic organic polymer being selected from the group consisting of diallyldimethylammonium chloride polymer, epichlorohydrin/dimethylamine copolymer, ethylene dichloride/ammonia copolymer and acrylamido N,N-dimethyl-piperazine quaternary/acrylamide copolymer: and then from 0.001 to 25 pounds per ton on a dry basis based on furnish of a colloidal silica with an average particle size within the range of from 1 to 100 nm; and from 0.1 to 5 pounds per ton on a dry basis, based on furnish of a high molecular weight charged acrylamide copolymer having a molecular weight of at least 500,000.

2. The method of claim 1, wherein the high molecular weight charged acrylamide copolymer is an anionic polymer.

3. The method of claim 1, wherein the high molecular weight charged acrylamide copolymer is a cationic polymer.

4. The method of claim 1 wherein the high molecular weight charged acrylamide polymers are selected from the group consisting of acrylic acid/acrylamide copolymer, dimethylamino ethylacrylate quaternary/acrylamide copolymer; dimethylamino ethylmethacrylate quaternary/acrylamide copolymer.

5. The method of claim 1, wherein the low molecular cationic polymer and the silica are present in a weight ratio of low molecular weight cationic polymer to silica of from 100:1 to 1:1; and the high molecular weight charged acrylamide copolymer and the colloidal silica are present in a weight ratio of high molecular weight charged acrylamide to silica of from 20:1 to 1:10.

* * * * *